US009913033B2

(12) United States Patent
Wyatt et al.

(10) Patent No.: US 9,913,033 B2
(45) Date of Patent: Mar. 6, 2018

(54) SYNCHRONIZATION OF INDEPENDENT OUTPUT STREAMS

(71) Applicant: Apple Inc., Cupertino, CA (US)

(72) Inventors: Douglas S. Wyatt, Cupertino, CA (US); Anthony J. Guetta, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 112 days.

(21) Appl. No.: 14/292,690

(22) Filed: May 30, 2014

(65) Prior Publication Data

US 2015/0350803 A1 Dec. 3, 2015

(51) Int. Cl.

| | |
|---|---|
| ***G10H 1/043*** | (2006.01) |
| ***G10H 1/16*** | (2006.01) |
| ***H04R 3/12*** | (2006.01) |
| *H04R 5/04* | (2006.01) |

(52) U.S. Cl.

CPC ..... *H04R 3/12* (2013.01); *H04R 5/04* (2013.01); *H04R 2499/11* (2013.01); *H04R 2499/15* (2013.01)

(58) Field of Classification Search

CPC . H04R 2400/03; H04R 2400/13; G06F 3/016; G08B 6/00; H04M 19/047; A63F 13/285

USPC ..... 381/61–62

See application file for complete search history.

(56) References Cited

U.S. PATENT DOCUMENTS

| | | | |
|---|---|---|---|
| 5,333,299 | A | 7/1994 | Koval et al. |
| 5,422,635 | A | 6/1995 | Morishima |
| 5,508,688 | A | 4/1996 | Mochizuki |
| 5,642,171 | A | 6/1997 | Baumgartner et al. |
| 5,696,497 | A | 12/1997 | Mottier et al. |
| 5,870,684 | A | 2/1999 | Hoashi et al. |
| 5,877,676 | A | 3/1999 | Shankarappa |
| 6,408,187 | B1 | 6/2002 | Merriam |
| 6,426,740 | B1 | 7/2002 | Goto |
| 6,438,393 | B1 | 8/2002 | Suuronen |
| 6,999,731 | B2 | 2/2006 | Cronin |
| 7,346,698 | B2 | 3/2008 | Hannaway |

(Continued)

FOREIGN PATENT DOCUMENTS

| | | |
|---|---|---|
| CN | 101076949 | 11/2007 |
| CN | 101795323 | 8/2010 |

(Continued)

OTHER PUBLICATIONS

U.S. Appl. No. 14/562,465, filed Dec. 5, 2014.
U.S. Appl. No. 14/702,705, filed May 2, 2015.

*Primary Examiner* — George Monikang
(74) *Attorney, Agent, or Firm* — Brownstein Hyatt Farber Schreck, LLP

(57) ABSTRACT

A system determines to use at least two independent renderers to render at least two output streams that are to be synchronized. The independent renderers are provided with a shared synchronization object when instructed to render the respective output stream. A time when all of the independent renderers can render a respective first buffer of the respective output stream is determined from the shared synchronization object. Rendering of the output streams utilizing the independent renderers is begun at the determined time. In this way, rendering of the output streams may be synchronized.

20 Claims, 6 Drawing Sheets

(56) References Cited

U.S. PATENT DOCUMENTS

| | | | | |
|---|---|---|---|---|
| 7,469,155 | B2 | 12/2008 | Chu | |
| 8,144,612 | B2 | 3/2012 | Johnson et al. | |
| 9,240,021 | B2 | 1/2016 | Rodriguez | |
| 9,265,458 | B2 | 2/2016 | Stack | |
| 9,390,599 | B2 | 7/2016 | Weinberg et al. | |
| 2002/0010008 | A1 | 1/2002 | Bork | |
| 2002/0107594 | A1* | 8/2002 | Taylor | G06F 9/544 700/94 |
| 2005/0176384 | A1 | 8/2005 | Matsuoka | |
| 2006/0088153 | A1 | 4/2006 | Wille | |
| 2008/0136652 | A1 | 6/2008 | Vaisnys | |
| 2009/0051509 | A1 | 2/2009 | Hwang | |
| 2010/0066512 | A1 | 3/2010 | Rank | |
| 2010/0148942 | A1* | 6/2010 | Oh | G10L 21/06 340/407.1 |
| 2011/0084795 | A1 | 4/2011 | Fukuyori | |
| 2012/0096398 | A1 | 4/2012 | Greenspan et al. | |
| 2012/0099594 | A1* | 4/2012 | Lau | H04L 12/2807 370/392 |
| 2012/0106651 | A1* | 5/2012 | Wang | H04N 21/4325 375/240.25 |
| 2013/0194177 | A1 | 8/2013 | Sakata | |
| 2013/0202134 | A1* | 8/2013 | Afshar | H04R 1/22 381/151 |
| 2014/0247120 | A1 | 9/2014 | Ullrich et al. | |
| 2014/0254813 | A1* | 9/2014 | Anderton | H04R 3/02 381/66 |
| 2014/0292501 | A1 | 10/2014 | Lim | |
| 2015/0154966 | A1 | 6/2015 | Bharitkar | |
| 2015/0256674 | A1 | 9/2015 | Iwasaki | |
| 2015/0348379 | A1 | 12/2015 | Moussette et al. | |
| 2016/0063848 | A1 | 3/2016 | Moussette et al. | |

FOREIGN PATENT DOCUMENTS

| | | |
|---|---|---|
| CN | 103179258 | 6/2013 |
| CN | 103181180 | 6/2013 |
| CN | 103778527 | 5/2014 |
| EP | 0973138 | 1/2000 |
| GB | 2367173 | 3/2002 |
| JP | 2005231381 | 9/2005 |
| JP | 2009015787 | 1/2009 |
| WO | WO 06/057770 | 6/2006 |

* cited by examiner

500A

| RENDERER | STATUS TIME | FRAMES REQUESTED FOR RENDERING | STATUS |
|---|---|---|---|
| SPEAKER | 100 | 100 | READY |
| HAPTIC | NA | NA | WAITING |

FIG. 5A

500B

| RENDERER | STATUS TIME | FRAMES REQUESTED FOR RENDERING | STATUS |
|---|---|---|---|
| SPEAKER | 100 | 100 | READY |
| HAPTIC | 125 | 50 | READY |

FIG. 5B

500C

| RENDERER | STATUS TIME | FRAMES REQUESTED FOR RENDERING | STATUS |
|---|---|---|---|
| SPEAKER | 100 | 100 | READY |
| HAPTIC | 175 | 50 | READY |

FIG. 5C

500D

| RENDERER | STATUS TIME | FRAMES REQUESTED FOR RENDERING | STATUS |
|---|---|---|---|
| SPEAKER | 200 | 100 | SYNCED |
| HAPTIC | 175 | 50 | SYNCED |

FIG. 5D

SYNCHRONIZATION OF INDEPENDENT OUTPUT STREAMS

TECHNICAL FIELD

This disclosure relates generally to streamed output, and more specifically to synchronization of independent output streams that may correspond to differing types of output, such as audio and haptic output.

BACKGROUND

Electronic devices may render streams of audio to drive components such as speakers, actuators, and so on. Typically, such electronic devices may render multiple streams of audio within a particular period of time. In some cases, the rendering of such multiple streams of audio may need to be synchronized with another type of output, such as a haptic or visual output.

For example, a haptic output device may include both a tactile and an audio component as part of a haptic output. The components that produce the tactile and audio components may be driven by data that is delivered ("streamed") from an internal processing unit. In such an example, many electronic devices simply output the tactile and audio outputs as they are received from the processing unit, according to a time stamp in the data streams of the tactile and audio data, or otherwise approximate rendering the two output types are roughly the same time.

However, these approaches do not necessarily yield true synchronized output. For example, the latency between the processing unit and one of the rendering components may be different than the latency between the processing unit and another of the rendering components. Likewise, data for one type of output may be ready or transmitted before the other type of data. Further, it may simply take more time for one of the rendering components to prepare and output its data.

Additionally, some electronic devices that utilize independent renderers to render each of the multiple output streams may not synchronize the renderings. To the contrary, such an electronic device may instruct independent renderers to render the various multiple streams and accept any lack of synchronization that occurs. Other electronic devices may combine rendering of the multiple streams into a single, unitary process. However, in such a case the rendering of the various multiple streams is not performed independently.

In the above cases, there may be a perceptible dissonance between the various types of output. They may appear to be out of sync, thereby losing their effectiveness and creating an unpleasant sensation in a user.

Accordingly, an improved apparatus and method for synchronizing output rendering may be useful.

SUMMARY

The present disclosure discloses systems, computer program products, and methods for synchronizing independent outputs; such outputs may be generated from streamed data. "Streamed" data, "streams," or "streaming," as used herein, may refer to transmission of data from a processing unit (whether a single processor, multiple processors, or one or more multi-core processors) to an electronic component that interprets the data and generates the output from the data (e.g., a "renderer" or "rendering component"). Accordingly, streams or streamed data may be transmitted entirely within a single electronic device.

As one example, two output streams that are to be synchronized may be rendered using independent renderers. The independent renderers are provided with a shared synchronization object when instructed to render the respective output stream. A time when all of the independent renderers can render buffered data from respective output streams may be determined from the shared synchronization object; rendering of the output streams utilizing the independent renderers may be begun at the determined time. In this way, rendering of the output streams may be synchronized. It should be appreciated that any number of output streams may be rendered in this fashion and there is no limitation or requirement that only two output streams are so processed. Sample output streams include audio streams, haptic streams, display streams, and so on.

The shared synchronization object may be one or more data structures, such as an array that includes data identifying the independent renderers, a status time for each independent renderer, a number of frames requested for rendering for each independent renderer, a status for each independent renderer, and/or any other such information. In some cases, information in the shared synchronization object may be analyzed to determine the synchronization time by ascertaining a next input/output cycle time of any renderer after all renderers are ready to render.

In one or more implementations, waveforms for one or more of the output streams may be retrieved from one or more non-transitory storage media and/or synthesized at the time of rendering. In various implementations, the output streams may have different sample frame rates, sampling rates, durations, and/or other rendering and/or other characteristics. However, in various other implementations one or more output streams may have one or more characteristics in common with each other.

In various embodiments, a system for synchronizing independent output streams may include at least one non-transitory storage medium storing instructions and at least one processing unit. The at least one processing unit may execute the instructions stored in the at least one non-transitory storage medium to: determine to render at least two output streams that are to be synchronized using at least two independent renderers; provide the at least two independent renderers a shared synchronization object when instructing the at least two renderers to render a respective one of the at least two output streams; determine from the shared synchronization object a time when all of the at least two independent renderers can render a respective first buffer of the respective one of the at least two output streams; and begin rendering the at least two output streams at the determined time utilizing the at least two renderers.

In some embodiments, a method for synchronizing independent output streams includes: determining to render at least two output streams that are to be synchronized using at least two independent renderers; providing the at least two independent renderers a shared synchronization object when instructing the at least two renderers to render a respective one of the at least two output streams; determining from the shared synchronization object a time when all of the at least two independent renderers can render a respective first buffer of the respective one of the at least two output streams; and beginning rendering the at least two output streams at the determined time utilizing the at least two renderers.

In one or more embodiments, a computer program product, tangibly embodied in at least one non-transitory storage medium, includes: a first set of instructions, stored in at least one non-transitory storage medium, executable by at least one processing unit to determine to render at least two output streams that are to be synchronized using at least two independent renderers; a second set of instructions, stored in the at least one non-transitory storage medium, executable by the at least one processing unit to provide the at least two independent renderers a shared synchronization object when instructing the at least two renderers to render a respective one of the at least two output streams; a third set of instructions, stored in the at least one non-transitory storage medium, executable by the at least one processing unit to determine from the shared synchronization object a time when all of the at least two independent renderers can render a respective first buffer of the respective one of the at least two output streams; and a fourth set of instructions, stored in the at least one non-transitory storage medium, executable by the at least one processing unit to begin rendering the at least two output streams at the determined time utilizing the at least two renderers.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

FIGS. 5A-5D are diagrams illustrating an example synchronization object for two output streams during synchronization.

DETAILED DESCRIPTION

Figure 1:
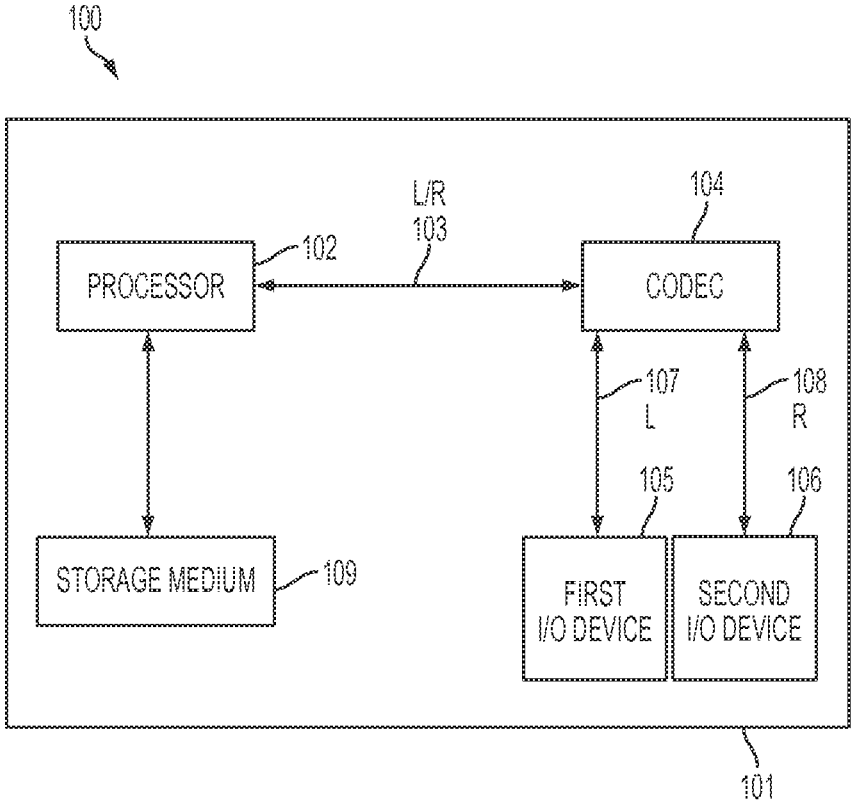
FIG. 1 is a block diagram illustrating an example system for synchronizing independent output streams.

The description that follows includes sample systems, methods, and computer program products that embody various elements of the present disclosure. However, it should be understood that the described disclosure may be practiced in a variety of forms in addition to those described herein.

The present disclosure discloses systems, computer program products, and methods for synchronizing independent output streams. At least two output streams that are to be synchronized may be determined to be rendered using at least two independent renderers. The independent renderers are provided with a shared synchronization object when instructed to render the respective output stream. A time when all of the independent renderers can render a respective first buffer of the respective output stream (i.e., "synchronization time") may be determined from the shared synchronization object. Rendering of the output streams utilizing the independent renderers may be begun at the determined time. In this way, rendering of the output streams may be synchronized. Such synchronization may ensure that a user experiences the outputs as intended. Further, in certain embodiments such synchronization may also enable component(s) to stay within a power utilization constraint that would be exceeded if the output streams were rendered without synchronization.

In some implementations, the output streams may be utilized to drive different components such as a speaker and an actuator that provides a haptic output. For example, a system may provide a haptic output that includes a sound produced by a speaker driven by a first rendered audio stream and a haptic output produced by an actuator driven by a second rendered haptic data stream. Synchronization of the two different output streams may ensure that the sound and haptic output are experienced by the user at the same time. Further, output streams may be designed to utilize the speaker and the actuator without available power at a given time. Synchronization may ensure that the speaker and actuator do not collectively use an unplanned excessive amount of power at the given time, staying within a constraint of available power.

Certain embodiments may employ the two channels of a stereo audio data stream to provide output streams for both the first and second output renderers or other devices. For example, a first channel of the stereo audio channel may be used to transmit data corresponding to a desired audio output. The second stereo channel may be used to transmit data corresponding to a desired haptic output from an actuator. This may be particularly useful where mono audio is desired from a speaker or set of speakers, insofar as the otherwise unused (or duplicate) audio channel may be used to transmit data for a second type of output. As another example, graphical data could be transmitted on this second stereo channel.

The aforementioned shared synchronization object may be one or more data structures such as an array. The shared synchronization object may include data identifying the independent renderers, a status time for each independent renderer, a number of frames requested for rendering for each independent renderer, a status for each independent renderer, and/or any other such information related to the independent renderers and/or rendering of the output streams.

In some cases, information in the shared synchronization object may be analyzed to determine the synchronization time by ascertaining a next input/output cycle time of any renderer after all renderers are ready to render. In this way, all of the independent renderers can be instructed to begin rendering at a synchronization time when all independent renderers are capable of rendering.

In some implementations, the independent renderers may employ the same codec, which is a program or hardware capable of encoding or decoding a digital data stream, under the direction of one or more processing units. In some cases of such implementations that produce a dual-nature output, including a sound produced by a speaker driven by a first rendered audio stream and a haptic output produced by an actuator driven by a second rendered haptic output stream, a processing unit may transmit the audio and haptic streams through a stereo audio channel. Similarly, the processing unit may be connected to each of the speaker and the actuator by mono audio channels, splitting the channels of the stereo audio connection from the processing unit.

In one or more implementations, waveforms for one or more of the output streams may be retrieved from one or more non-transitory storage media (such in the case of system sounds that have been pre-synthesized and stored for frequent use, accessible by referencing a lookup table and/or other data structure) and/or synthesized at the time of rendering. In various implementations, the output streams may have different sample frame rates, sampling rates, durations, and/or other rendering and/or other characteristics. However, in various other implementations one or more output streams may have one or more characteristics in common with each other.

FIG. 1 is a block diagram illustrating an example system 100 for synchronizing independent output streams. The system may include an electronic device 101 which may be any kind of electronic device such as a laptop computer, a desktop computer, a wearable device, a timekeeping device, a health monitoring device, a digital media player, a mobile computer, a cellular telephone, a smart phone, and/or any other electronic device that renders output streams.

The electronic device 101 may include one or more processing units 102, one or more codecs (e.g., digital to analog converters) 104 (in the event the codec is implemented as a stand-alone device or circuit, rather than being a program executed by the processing unit), one or more first input/output devices 105 (such as one or more speakers and/or other audio output devices), one or more second input/output devices 106 (such as one or more actuators and/or other tactile output devices), and one or more non-transitory storage media 109 (which may take the form of, but is not limited to, a magnetic storage medium; optical storage medium; magneto-optical storage medium; read only memory; random access memory; erasable programmable memory; flash memory; and so on).

As illustrated, in some cases the processing unit 102 may be connected to the codec 104 by a stereo audio channel 103, or may be connected directly to the output devices 105, 106. Similarly, the codec may be connected to the first input/output device 105 by a first mono audio channel 107 and to the second input/output device 106 by a second mono audio channel 108, splitting the channels of the stereo channel to the processor. However, it is understood that this is an example and that in various implementations any number of connections having any number of channels between any number of processors, codecs, and input/output devices are possible without departing from the scope of the present disclosure. Further, it should be appreciated that one or both of the input/output devices 105, 106 may lack input functionality in certain embodiments and be only output devices, such as a speaker, haptic actuator, and the like.

The processing unit 102 may execute instructions stored in the non-transitory storage medium 109 that cause the processing unit to determine to render at least two output streams that are to be synchronized.

For example, the processing unit 102 may receive a user input and the processing unit may determine to provide a haptic response to the user input. The first input/output device 105 in this example may be a speaker and the second input/output device 106 may be an actuator in this example. The processing unit may determine to provide a haptic response to the user input by driving both the speaker and the actuator respectively using two separate and independent output streams. In order for the sound and haptic output to be perceived by the user as part of the same overall response, the output streams may need to be synchronized. Further, the output streams that drive the speaker and actuator may be designed to stay within a power constraint at a particular time of the electronic device 101. If the output streams driving the speaker and actuator are not synchronized, power utilized by driving the speaker and the actuator may be more than expected by designers and may exceed available power at a given time. As such, synchronization of the output streams may enable the electronic device to stay within power constraints.

The processing unit 102 may utilize the codec 104 to render the output streams (e.g., to encode the streams). This may be particularly useful when, for example, the output streams are left and right channels of a stereo audio channel. Each of the output streams is generally transmitted to a separate output device 105, 106, even if both are instantiated as the left and right audio channels of the stereo data.

Although the processing unit may instruct a single hardware component to render the output streams in some implementations, separate independent renderers may be executed in software to encode each of the output streams. In some cases, the separate independent renderers may all be executed by the same codec or other hardware. Likewise, in some embodiments the codec may be a program executed by the processing unit 102, rather than separate hardware. Further, in some embodiments the renderer or renderers may use one or more codecs, or may output data to one or more codecs, for encoding or decoding.

The independent renderers may be provided with a shared synchronization object when instructed (such as by the processing unit 102) to render the respective output stream. A time (i.e., synchronization time) when all of the independent renderers can render a respective first buffer of the respective output stream may be determined from the synchronization object. Each of the independent renderers may begin rendering the respective output stream at the determined time, synchronizing rendering of the output streams.

In various cases, the output streams may (or may not) have different sample frame rates, sampling rates, durations, and/or any other characteristics. The independent renderers may attempt to begin rendering at various times. However, utilization of the shared synchronization object may enable synchronization despite these factors.

In some implementations, the shared synchronization object may be one or more data structures such as an array, table, list, and/or other data structure. The shared synchronization object may include data that identifies all of the independent renderers, a status of each of the independent renderers (such as a "ready" status, a "waiting" status, a "cancelled" status, and/or other such statuses), a status time for each independent renderer, a number of frames requested for rendering for each independent renderer, and/or other information related to the independent renderers.

The shared synchronization object may be analyzed to determine the synchronization time by ascertaining a next input/output cycle time of any renderer after all renderers are ready to render. In this way, the synchronization time may be set as a time when all of the independent renderers will be ready to render. The independent renderers may be instructed to begin rendering at that determined synchronization time.

In some cases, waveforms for one or more of the output streams may be retrieved from the non-transitory storage medium 109 for rendering. For example, frequently used sounds such as "system sounds" may be pre-synthesized and stored, accessible by referencing a lookup table and/or other data structure for a particular reference number associated with a particular system sound, retrievable upon determination to render. In other cases, waveforms for one or more of the output streams may be synthesized at the time of rendering. Regardless, the synchronization techniques described in the present disclosure may be unaffected by whether the output streams are stored and retrieved and/or synthesized at the time of rendering.

Figure 2:
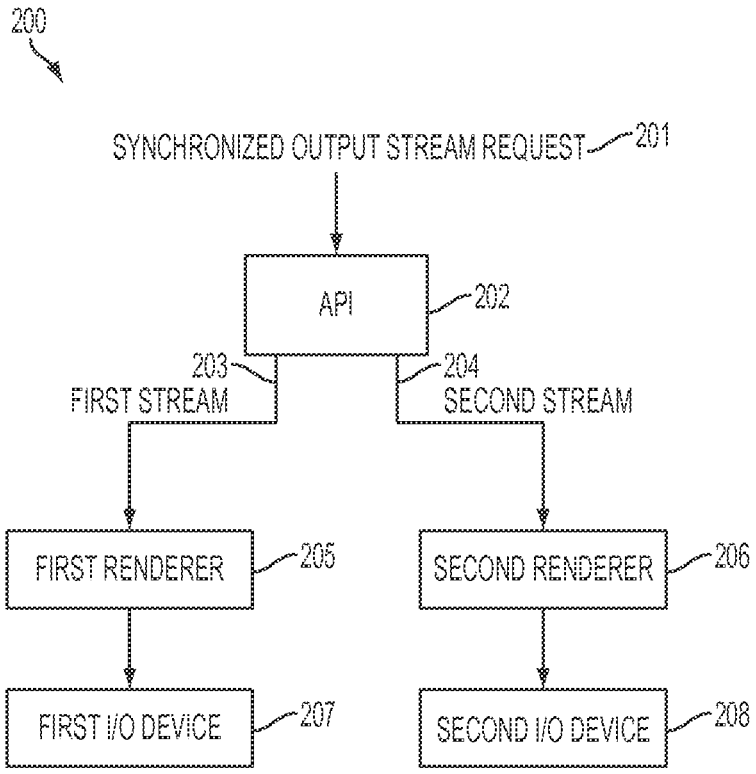
FIG. 2 is a block diagram illustrating the functioning of example software elements that may be executed by the system of FIG. 1.

FIG. 2 is a block diagram illustrating the functioning 200 of example software elements that may be executed by the system of FIG. 1. As illustrated, an application programming interface 202 (which may be executed by the processing unit 102 of the electronic device 101 of FIG. 1) may receive a request 201 to synchronize the rendering multiple output streams. The application programming interface may instruct separate software renderers 205-206 to each render one of the multiple output streams. As part of such instruction, the application programming interface may also pass the independent renderers a shared synchronization object. A synchronization time when the independent renderers can all render their respective output streams may be determined and the independent renderers may begin rendering their respective output streams (respectively providing the respective rendered streams to drive a first input/output device 207 and a second input/output device 208) at that determined time.

In this example, the multiple output streams may be two output streams that are to be synchronized. As illustrated, FIG. 2 includes a first renderer 205 that is instructed to render a first audio stream 203, corresponding to an audio output, and a second renderer 206 that is instructed to render a second haptic output stream 204, corresponding to a haptic output. However, it is understood that this is an example and that any number of output streams rendered by any number of independent renderers may be synchronized.

Figure 3:
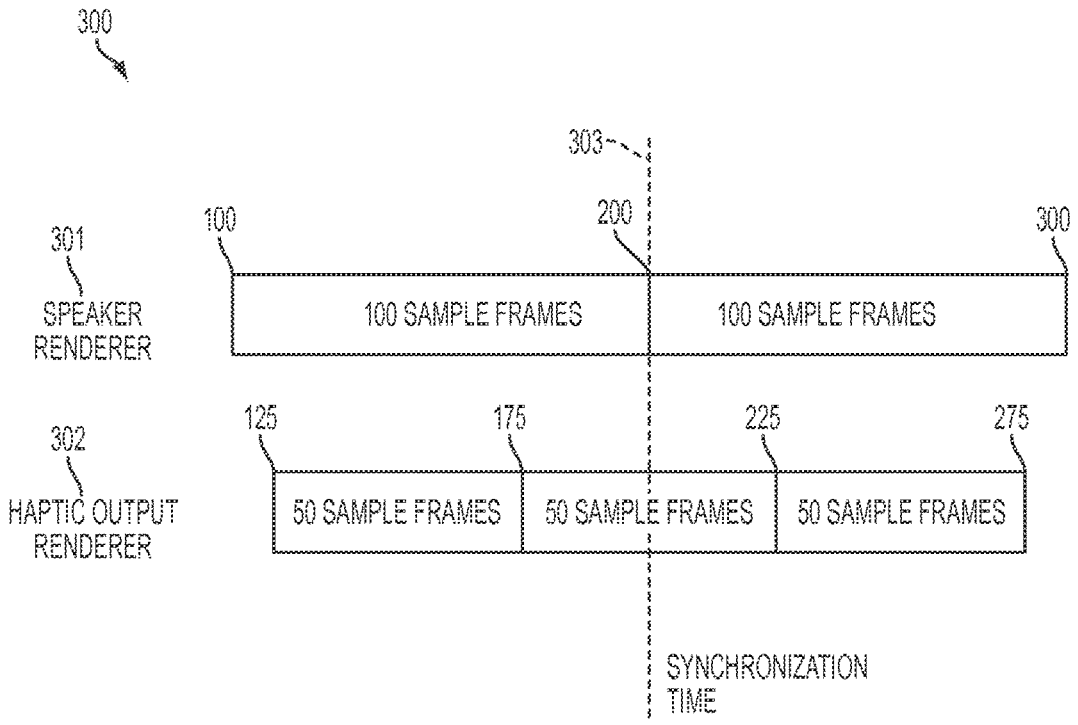
FIG. 3 is a diagram illustrating an example of the operation of two independent renderers for which a synchronization time is determined.

FIG. 3 is a diagram illustrating an example of the operation 300 of two independent renderers 301 and 302 for which an embodiment may determine a synchronization time 303. In this example, the first independent renderer may be a speaker renderer that drives a speaker and the second independent renderer may be a haptic renderer that drives an actuator. However, it is understood that this is an example and any number of various kinds of independent renderers may be utilized without departing from the scope of the present disclosure.

As illustrated, the speaker renderer 301 attempts to begin rendering at a time 100 and has a buffer size of 100 sample frames. Thus, the speaker renderer could begin rendering the first buffer of 100 sample frames between the time 100 and a time 200 and a second buffer of 100 sample frames between the time 200 and a time 300. As also illustrated, the haptic renderer 302 may attempt to begin rendering at a time 125 and has a buffer size of 50 sample frames. Thus, the haptic renderer could begin rendering the first buffer of 50 sample frames between the time 125 and a time 175, a second buffer of 50 sample frames between the time 175 and a time 225, and a third buffer of 50 sample frames between the time 225 and a time 275.

However, as illustrated, the haptic renderer 302 is not ready to render its first buffer of 50 sample frames at the time 100 when the speaker renderer 301 is ready to render its first buffer of 100 sample frames. The synchronization time 303 may therefore be set equal to the time 200, corresponding to the next input/output cycle of the speaker renderer, as that is the next time the speaker renderer will check in and determine that the haptic renderer is be ready to render its first buffer of 50 sample frames. As such, the speaker renderer may begin rendering its first buffer of 100 sample frames at the synchronization time 303 (the time 200) and the haptic renderer also may begin rendering its first buffer of 50 sample frames at the synchronization time 303.

Although FIG. 3 sets the synchronization time 303 as the next input/output cycle of the speaker renderer 301 after both renderers 301 and 302 are ready to render their respective first buffer of sample frames because the input/output cycle of the speaker renderer is longer, it is understood that this is an example and other configurations are possible. For example, both renderers are capable of rendering their respective first buffer of sample frames as of the time 175, and in some implementations such a time when all independent renderers are capable of rendering their respective first buffer frame may be selected as the synchronization time (i.e., the time 175 in this example).

Certain embodiments may add an inter-channel time delay to one or both of the output streams prior to rendering as perceptible output. As one example, the delay may be added to the beginning of one of the buffers or one of the frames, and typically to the beginning of the buffer or frame. The delay may be added in order to account for a time delay between a user perceiving a first type of output and a second type of output, in certain embodiments. The delay may thus have the result that the first and second types of output are perceived by the user at the same time even though one is slightly delayed. It should be appreciated that the first and second output types are still synchronized and the frames/buffers may be substantially simultaneously rendered, as described herein; the initial portion of one buffer/frame may equate to zero output through operation of the added time delay.

As one non-limiting example, consider an electronic device employing certain embodiments described herein to provide an audio output and a haptic output, with data for both types of output being encoded and transmitted by a processing unit to the respective output devices on first and second channels of an internal stereo audio connection. If the electronic device is typically worn or held by a user and the two outputs are provided simultaneously (e.g., synchronized with one another and without any time delay), then the user will feel the haptic output before he hears the audio output because the audio output must travel from the device to the user's ear, while the haptic output nearly instantly impacts the user's skin. Thus, even though the two outputs are synchronized and rendered simultaneously, the perceptual delay by the user may make them appear to be asynchronous.

Accordingly, the time delay (if any) implemented in an embodiment may be chosen based on a number of factors, such as the types of output being provided, the type of output being delayed, the assumed or actual location or distance of the device with respect to a user or a user's sensory organs, whether a user is touching the device, and so on. In some cases the time delay may be a default value that is inserted into a buffer or frame while in other cases the time delay may be dynamically calculated based, for example, on sensor data gathered by the electronic device.

FIGS. 5A-5D are diagrams illustrating an example synchronization object 500A-500D for two output streams during synchronization corresponding to the operation 300 illustrated in FIG. 3. As illustrated in this example, the synchronization object may be an array with rows for each of the speaker renderer 301 and haptic renderer 302 of FIG. 3. As also illustrated in this example, the synchronization object may have rows for the status time for each of the independent renderers, the frames requested for rendering for each of the independent renderers, and the status of each of the independent renderers.

Though the synchronization object 500A-500D is illustrated as an array with particular data elements in FIGS. 5A-5D, it is understood that this is an example. In various implementations, any kind of data structure(s) with any kind of data elements may be utilized without departing from the scope of the present disclosure.

FIG. 5A may represent the state of the synchronization object 500A at the time 100 illustrated in FIG. 3. As shown, at the time 100 the speaker renderer may interact with the synchronization object to update its status time, frames requested for rendering, and/or status. As such, the synchronization object at this time may have a value of 100 for the speaker renderer's status time, a value of 100 for the speaker renderer's frames requested for rendering, and a value of "ready" for the speaker renderer's status. However, the synchronization object at this time may have a value of NA for the haptic renderer's status time, a value of NA for the haptic renderer's frames requested for rendering, and a value of "waiting" for the haptic renderer's status as the haptic renderer has not attempted to begin rendering and/or accessed the synchronization object at the time 100.

FIG. 5B may represent the state of the synchronization object 500B at the time 125 illustrated in FIG. 3. As shown, at the time 125 the haptic renderer may interact with the synchronization object to update its status time, frames requested for rendering, and/or status. As such, the synchronization object at this time may have a value of 125 for the haptic renderer's status time, a value of 50 for the haptic renderer's frames requested for rendering, and a value of "ready" for the haptic renderer's status. However, the synchronization object at this time still may have a value of 100 for the speaker renderer's status time, a value of 100 for the speaker renderer's frames requested for rendering, and a value of "ready" for the speaker renderer's status as the speaker renderer has not reached its next input/output cycle yet.

As the synchronization object 500B indicates that both of the independent renderers are ready to render at the time 125, the synchronization time may then be determined from the synchronization object. The synchronization object indicates that the speaker renderer has a status time of 100 and a number of frames requested for rendering of 100. As such, the synchronization object indicates that the next input/output cycle for the speaker renderer will be at the time 200 (or status time added to the frames requested for rendering). Similarly, the synchronization object indicates that the haptic renderer has a status time of 125 and a number of frames requested for rendering of 50. As such, the synchronization object indicates that the next input/output cycle for the haptic renderer will be at the time 175. However, as the speaker renderer will not check in until the speaker renderer's next cycle time (time 200) to learn that all renderers are ready, the time of the speaker renderer's next cycle time is selected as the synchronization time.

FIG. 5C may represent the state of the synchronization object 500C at the time 175 illustrated in FIG. 3. As shown, at the time 175 the haptic renderer may interact with the synchronization object to update its status time, frames requested for rendering, and/or status. As such, the synchronization object at this time may have a value of 175 for the haptic renderer's status time, a value of 50 for the haptic renderer's frames requested for rendering, and a value of "ready" for the haptic renderer's status. However, the synchronization object at this time still may have a value of 100 for the speaker renderer's status time, a value of 100 for the speaker renderer's frames requested for rendering, and a value of "ready" for the speaker renderer's status as the speaker renderer has not reached its next input/output cycle yet.

FIG. 5D may represent the state of the synchronization object 500D at the time 200 illustrated in FIG. 3. As shown, at the time 200 the speaker renderer may interact with the synchronization object to update its status time, frames requested for rendering, and/or status. As such, the synchronization object at this time may have a value of 200 for the speaker renderer's status time, a value of 100 for the speaker renderer's frames requested for rendering, and a value of "synced" or "synchronized" for the speaker renderer's status. As the synchronization time (the time 200) has been reached, the speaker renderer and the haptic renderer may begin rendering their respective output streams.

Although the synchronization time in the above example was determined as the next input/output cycle time of the renderer with the longest input output cycle time, this may not be the case in all examples. The synchronization time may in fact be determined as the maximum of the next input/output cycle time that will occur for any renderer after all renderers check in. For purposes of such an analysis, the "next" input/output cycle time of a renderer, as it checks in, is actually that renderer's current input/output cycle time insofar as a renderer can check in, cause synchronization to be established and then begin rendering immediately. As one example, if the haptic renderer had checked in at a time 75 before the speaker renderer checked in at time 100, all renderers would have been ready to render at time 100 and the synchronization time may have been set as the next input/output cycle time for any renderer, which would have been time 125 for the haptic renderer.

Figure 4:
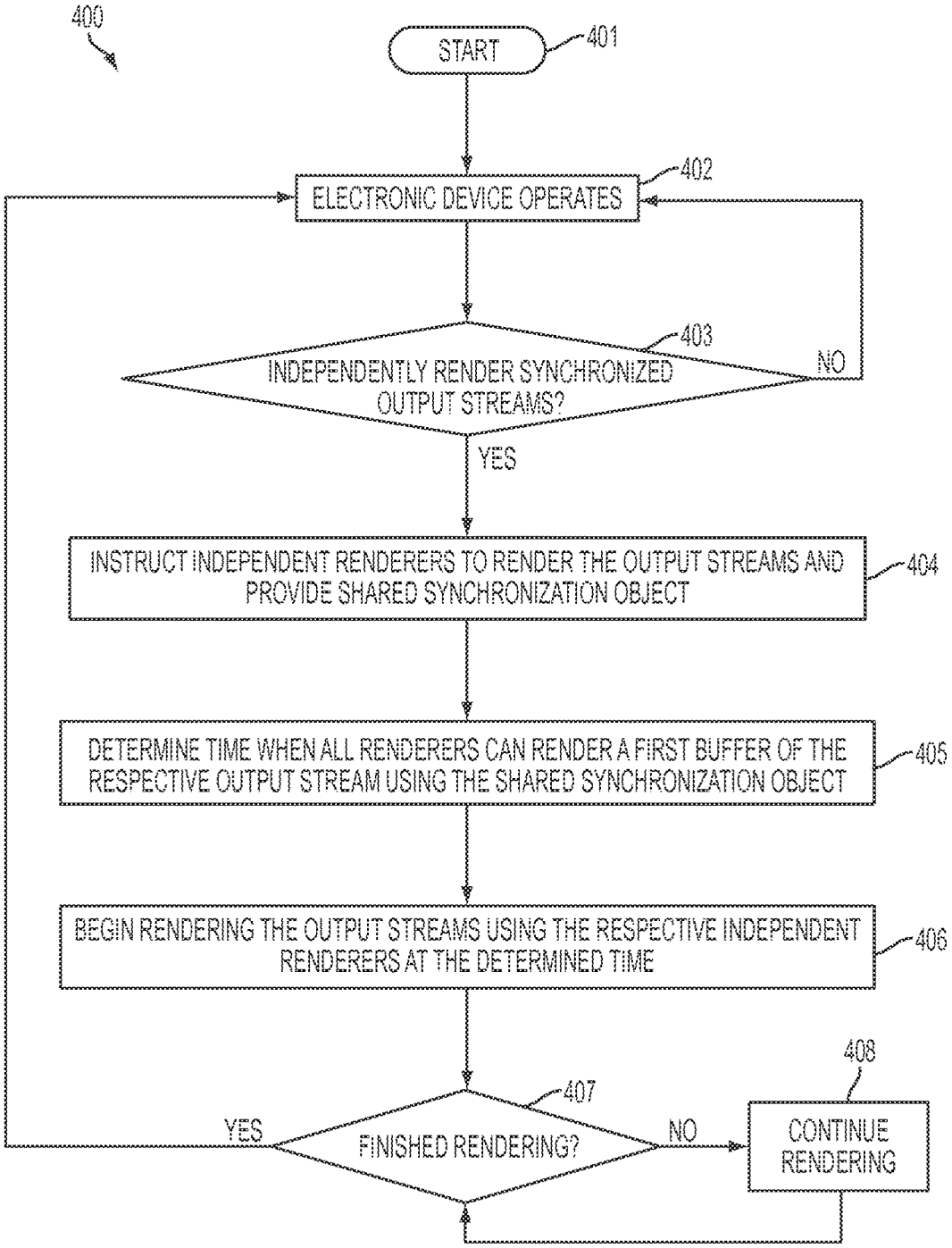
FIG. 4 is a flow chart illustrating an example method for synchronizing independent output streams. This method may be performed by the system of FIG. 1.

FIG. 4 is a flow chart illustrating an example method 400 for synchronizing independent output streams. This method may be performed by the system of FIG. 1 and such independent output streams may be transmitted across the two channels of a stereo audio channel, as one non-limiting example. In such an embodiment, the output streams may each be transmitted as or on an audio channel.

The flow begins at block 401 and proceeds to block 402 where an electronic device operates. The flow then proceeds to block 403 where it is determined whether or not to independently render output streams that are to be synchronized. If so, the flow proceeds to block 404. Otherwise, the flow returns to block 402 where the electronic device continues to operate.

At block 404, after it is determined to independently render output streams that are to be synchronized, independent renderers are instructed to render each of the output streams and are each provided a shared synchronization object. The flow then proceeds to block 405 where a time is determined from the shared synchronization object when all independent renderers can render a first buffer of their respective output stream. Next, the flow proceeds to block 406 where rendering of each of the output streams is begun using the respective independent renderers at the determined time.

The flow then proceeds to block 407 where it is determined whether or not rendering of the output streams is completed. If so, the flow returns to block 402 and the electronic device continues to operate. Otherwise, the flow proceeds to block 408.

At block 408, rendering of one or more of the output streams continues. The flow then returns to block 407 where it is determined whether or not rendering of the output streams is completed.

Although the example method 400 is illustrated and described as performing particular operations in a particular order, it is understood that this is an example. In various implementations, various orders of the same, similar, and/or different operations may be performed without departing from the scope of the present disclosure.

For example, the example method 400 is illustrated and described as determining whether or not rendering is finished at block 407. However, in various implementations such a determination may not be performed. Instead, the flow may return directly from block 406 to block 402 when rendering of all output streams completes and/or is otherwise cancelled.

As described above and illustrated in the accompanying figures, the present disclosure discloses systems, computer program products, and methods for synchronizing independent output streams. At least two output streams that are to be synchronized may be determined to be rendered using at least two independent renderers. The independent renderers may be provided with a shared synchronization object when instructed to render the respective output stream. A time when all of the independent renderers can render a respective first buffer of the respective output stream may be determined from the shared synchronization object. Rendering of the output streams utilizing the independent renderers may be begun at the determined time. In this way, rendering of the output streams may be synchronized. Such synchronization may ensure that a user experiences the rendered output streams as intended. Such synchronization may also enable component(s) to stay within a power utilization constraint that would be exceeded if the output streams were rendered without synchronization.

Although the present disclosure is illustrated and described above as synchronizing output streams, it is understood that this is an example. In various implementations, streams other than audio may be synchronized without departing from the scope of the present disclosure.

Further, although a specific architecture is discussed (such as two channels of a stereo stream between a processing unit and a codec), it is understood that this is an example. In various implementation the synchronization techniques discussed herein may be utilized to synchronize output streams rendered utilizing two or more separate hardware outputs.

Additionally, though the present disclosure is illustrated and described as synchronizing streams that are rendered in a single linear sequence, it is understood that this is an example and that other arrangements are possible and contemplated. For example, a ringtone may include a sound and a vibration that are repeated periodically but may not have identical durations. In such an example case, rendering the ringtone may include loops of rendering the sound and vibration and the synchronization techniques discussed herein may be utilized to synchronize the start point of each loop. In various cases, a delay caused in rendering the first loop may or may not be repeated in subsequent loops.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computer system (or other electronic devices) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

One or more Application Programming Interfaces (APIs) may be used in some embodiments and functionality discussed herein may be implemented as, or access by, an API. An API is an interface implemented by a program code component or hardware component (hereinafter "API-implementing component") that allows a different program code component or hardware component (hereinafter "API-calling component") to access and use one or more functions, methods, procedures, data structures, classes, and/or other services provided by the API-implementing component. An API can define one or more parameters that are passed between the API-calling component and the API-implementing component.

An API allows a developer of an API-calling component (which may be a third party developer) to leverage specified features provided by an API-implementing component. There may be one API-calling component or there may be more than one such component. An API can be a source code interface that a computer system or program library provides in order to support requests for services from an application. An operating system (OS) can have multiple APIs to allow applications running on the OS to call one or more of those APIs, and a service (such as a program library) can have multiple APIs to allow an application that uses the service to call one or more of those APIs. An API can be specified in terms of a programming language that can be interpreted or compiled when an application is built.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. A system for synchronizing independent output streams, comprising:

at least one non-transitory storage medium storing instructions; and at least one processing unit that executes the instructions stored in the at least one non-transitory storage medium to: determine to render at least two output streams that are to be synchronized using at least first and second independent renderers;

provide the first and second independent renderers a shared synchronization object when instructing the first and second independent renderers to render a respective one of the at least two output streams;

determine, from the shared synchronization object, a render time when all of the first and second independent renderers can render based on a latest of a first time and a second time; and begin rendering the at least two output streams at the render time utilizing the first and second independent renderers; wherein the shared synchronization object includes the first time and the second time;

the first time is added to the shared synchronization object by the first independent renderer;

the second time is added to the shared synchronization object by the second independent renderer;

the first time indicates when the first independent renderer can first render a first respective buffer; and the second time indicates when the second independent renderer can first render a second respective buffer.

2. The system of claim 1, wherein the at least two output streams are transmitted as first and second audio channels of a stereo audio channel to the first and second independent renderers.

3. The system of claim 2, wherein the shared synchronization object identifies the first and second independent renderers, a status time for each of the first and second independent renderers, a number frames requested for rendering for each of the first and second independent renderers, and a status for each of the first and second independent renderers.

4. The system of claim 2, wherein the shared synchronization object comprises an array.

5. The system of claim 2, wherein a time delay is inserted into a beginning of the first respective buffer.

6. The system of claim 2, further comprising a codec that executes both of the first and second independent renderers.

7. The system of claim 6, wherein the codec is coupled to the at least one processing unit by a stereo audio connection.

8. The system of claim 7, wherein the codec is coupled to a speaker by a first audio connection and an actuator by a second audio connection.

9. The system of claim 8, wherein the first audio connection and the second audio connection are both mono audio connections.

10. The system of claim 2, wherein the at least one processing unit determines the time when all of the first and second independent renderers can render by utilizing the shared synchronization object to ascertain that all of the first and second independent renderers have checked in.

11. The system of claim 2, further comprising a first codec that receives the output of the first of the first and second independent renderers and a second codec that receives the output of the second of the first and second independent renderers.

12. The system of claim 2, wherein the at least two output streams are rendered in multiple loops and a starting point for each loop is determined from the shared synchronization object.

13. The system of claim 2, wherein a waveform for at least one of the at least two output streams is retrieved from the at least one non-transitory storage medium for rendering.

14. The system of claim 2, wherein a waveform for at least one of the at least two output streams is synthesized for rendering.

15. The system of claim 2, wherein the at least two output streams have different numbers of frames requested for rendering.

16. The system of claim 2, wherein the at least two output streams have different sampling rates.

17. The system of claim 2, wherein the at least two output streams have different durations.

18. The system of claim 2, wherein synchronization of the at least two output streams enables the system to stay within a power utilization constraint.

19. A method for synchronizing independent output streams, the method comprising:

determining to render at least two output streams that are to be synchronized using at least first and second independent renderers;

providing the first and second independent renderers a shared synchronization object when instructing the first and second independent renderers to render a respective one of the at least two output streams;

determining, from the shared synchronization object, a render time when all of the first and second independent renderers can render based on a latest of a first time and a second time; and beginning rendering the at least two output streams at the render time utilizing the first and second independent renderers; wherein the shared synchronization object includes the first time and the second time;

the first time is added to the shared synchronization object by the first independent renderer;

the second time is added to the shared synchronization object by the second independent renderer;

the first time indicates when the first independent renderer can first render a first respective buffer; and the second time indicates when the second independent renderer can first render a second respective buffer.

20. A computer program product, tangibly embodied in at least one non-transitory storage medium, comprising:

a first set of instructions, stored in at least one non-transitory storage medium, executable by at least one processing unit to determine to render at least two output streams that are to be synchronized using at least first and second independent renderers;

a second set of instructions, stored in the at least one non-transitory storage medium, executable by the at least one processing unit to provide the first and second independent renderers a shared synchronization object when instructing the first and second independent renderers to render a respective one of the at least two output streams;

a third set of instructions, stored in the at least one non-transitory storage medium, executable by the at least one processing unit to determine, from the shared synchronization object, a render time when all of the first and second independent renderers can render based on a latest of a first time and the second time; and a fourth set of instructions, stored in the at least one non-transitory storage medium, executable by the at least one processing unit to begin rendering the at least two output streams at the render time utilizing the first and second independent renderers; wherein the shared synchronization object includes the first time and the second time;

the first time is added to the shared synchronization object by the first independent renderer;

the second time is added to the shared synchronization object by the second independent renderer;

the first time indicates when the first independent renderer can first render a first respective buffer; and the second time indicates when the second independent renderer can first render a second respective buffer.

* * * * *